US008225516B2

(12) United States Patent
Green

(10) Patent No.: US 8,225,516 B2
(45) Date of Patent: Jul. 24, 2012

(54) PENCIL SHARPENING DEVICE

(76) Inventor: Joe Green, Urbandale, IA (US)

( * ) Notice: Subject to any disclaimer, the term of this patent is extended or adjusted under 35 U.S.C. 154(b) by 1193 days.

(21) Appl. No.: 11/684,659

(22) Filed: Mar. 12, 2007

(65) Prior Publication Data

US 2007/0151113 A1 Jul. 5, 2007

Related U.S. Application Data

(63) Continuation-in-part of application No. 10/853,066, filed on May 25, 2004, now abandoned, which is a continuation-in-part of application No. 11/160,674, filed on Jul. 5, 2005.

(51) Int. Cl.
*B43L 23/00* (2006.01)

(52) U.S. Cl. ..... 30/453; 30/451

(58) Field of Classification Search ..... 30/451–462; 144/28.1–28.9; D19/73; 83/100
See application file for complete search history.

(56) References Cited

U.S. PATENT DOCUMENTS

| | | | | |
|---|---|---|---|---|
| 2,096,762 | A * | 10/1937 | Quinby | 30/454 |
| 2,525,854 | A | 10/1950 | Becker | |
| 2,691,960 | A | 10/1954 | Leeds et al. | |
| 3,229,670 | A * | 1/1966 | Mourra | 144/28.5 |
| 3,237,607 | A | 3/1966 | O'Brien | |
| 3,456,590 | A * | 7/1969 | Sparr, Sr. | 417/36 |
| 4,132,644 | A * | 1/1979 | Kolberg | 210/85 |
| 4,281,698 | A | 8/1981 | Mobius | |
| 2006/0288593 | A1 * | 12/2006 | Peterson et al. | 30/453 |

FOREIGN PATENT DOCUMENTS

| | | |
|---|---|---|
| DE | 196 40 909 A1 | 4/1998 |
| GB | 2 359 279 A | 8/2001 |
| JP | 8 300894 | 11/1996 |

* cited by examiner

*Primary Examiner* — Stephen Choi
(74) *Attorney, Agent, or Firm* — Zarley Law Firm, P.L.C.

(57) ABSTRACT

The present invention is a pencil sharpener having a hollow container having a sidewall, a closed bottom and a lid, a sharpening element being mounted on the lid, the lid having an opening below the sharpening element such that pencil shavings pass through the opening in the lid and into the hollow container.

12 Claims, 6 Drawing Sheets

PENCIL SHARPENING DEVICE

CROSS REFERENCE TO RELATED APPLICATION

This application is a continuation-in-part of application Ser. No. 10/853,066 filed May 25, 2004, which is a continuation-in-part of application Ser. No. 11/160,674 filed Jul. 5, 2005.

BACKGROUND OF THE INVENTION

This invention is directed to a device for sharpening pencils and more specifically a device for capturing pencil shavings for use in a classroom.

For many years conventional pencil sharpeners have been mounted on classroom walls and counters. These sharpeners have small containers for capturing wood shavings that require their removal for emptying the shavings on a frequent basis. This coupled with the sometimes careless handling by children results in occasional damage to the sharpener requiring replacement. Over time, the replacement of pencil sharpeners can become very expensive for schools that are in need of money. Additionally, the need to replace the shavings container can become a nuisance.

Specifically, hand crank models of sharpeners are very prone to wear and tear. The constant removal and reattachment of the cover of the hand crank models wears down the surfaces of the sharpener. This constant removal and reattachment to clean out shaving additionally causes pencil dust and shavings to cover materials near the sharpener thus creating a dirty classroom environment. Furthermore, the pot metal used to construct the frame of some of the crank handle sharpeners has a very low tensile strength and therefore is easily snapped off near the mounting base.

Accordingly, there is a need in the art for an improved pencil sharpener that can withstand the wear and tear from children in a classroom and that also does not need to be emptied as frequently. Therefore, it is a primary object of the present invention to provide a durable pencil sharpener that improves upon the state of the art.

Another object of the present invention is to provide a pencil sharpener that requires less maintenance.

Yet another object of the present invention is to provide a pencil sharpener that is free standing.

These and other objects, features, or advantages of the present invention will become apparent from the specification and claims.

BRIEF SUMMARY OF THE INVENTION

The present invention is a pencil sharpener having a container with a lid that is releasably secured to the open top of the container. Mounted to the support member and extending upwardly through the aperture is a sharpening element.

DESCRIPTION OF THE PREFERRED EMBODIMENTS OF THE INVENTION

Figure 1:
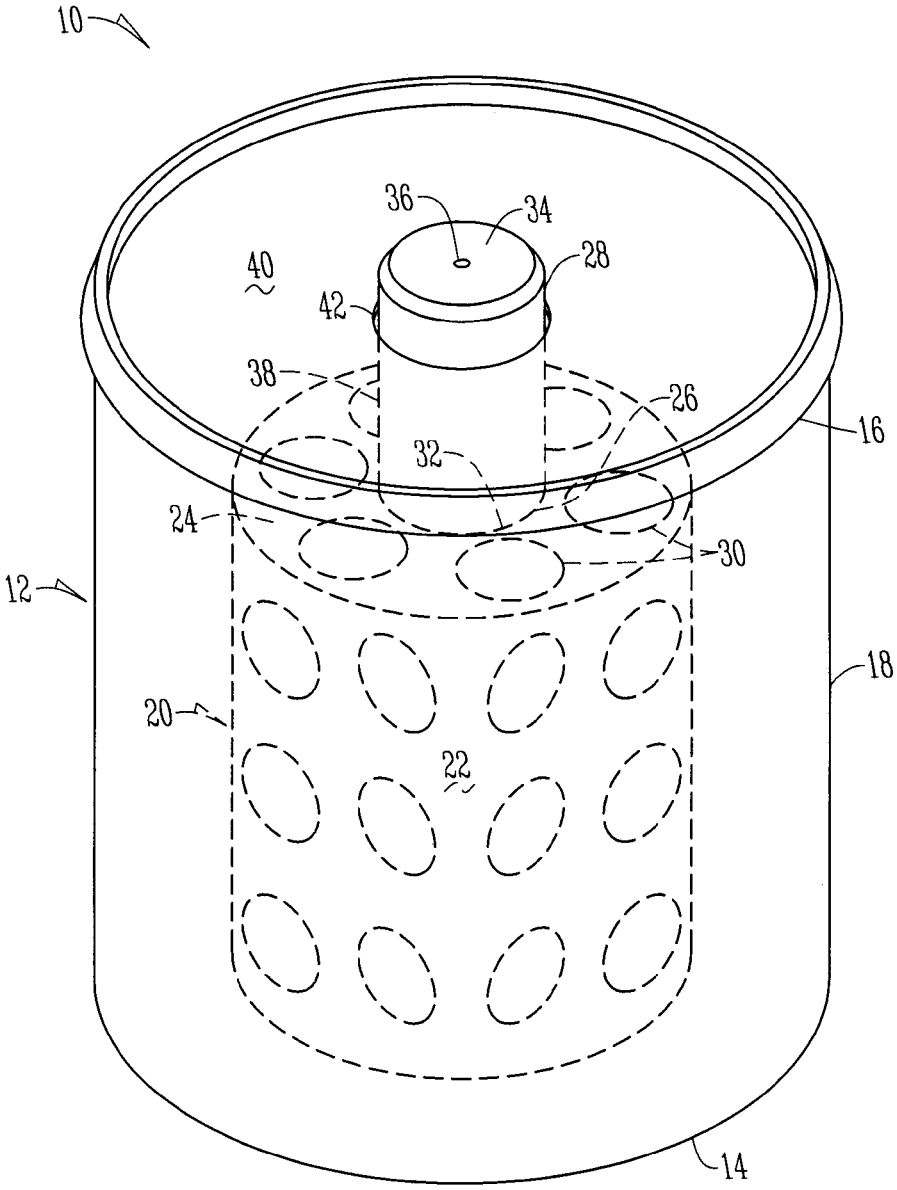
FIG. 1 is a perspective view of the present invention.
Figure 2:
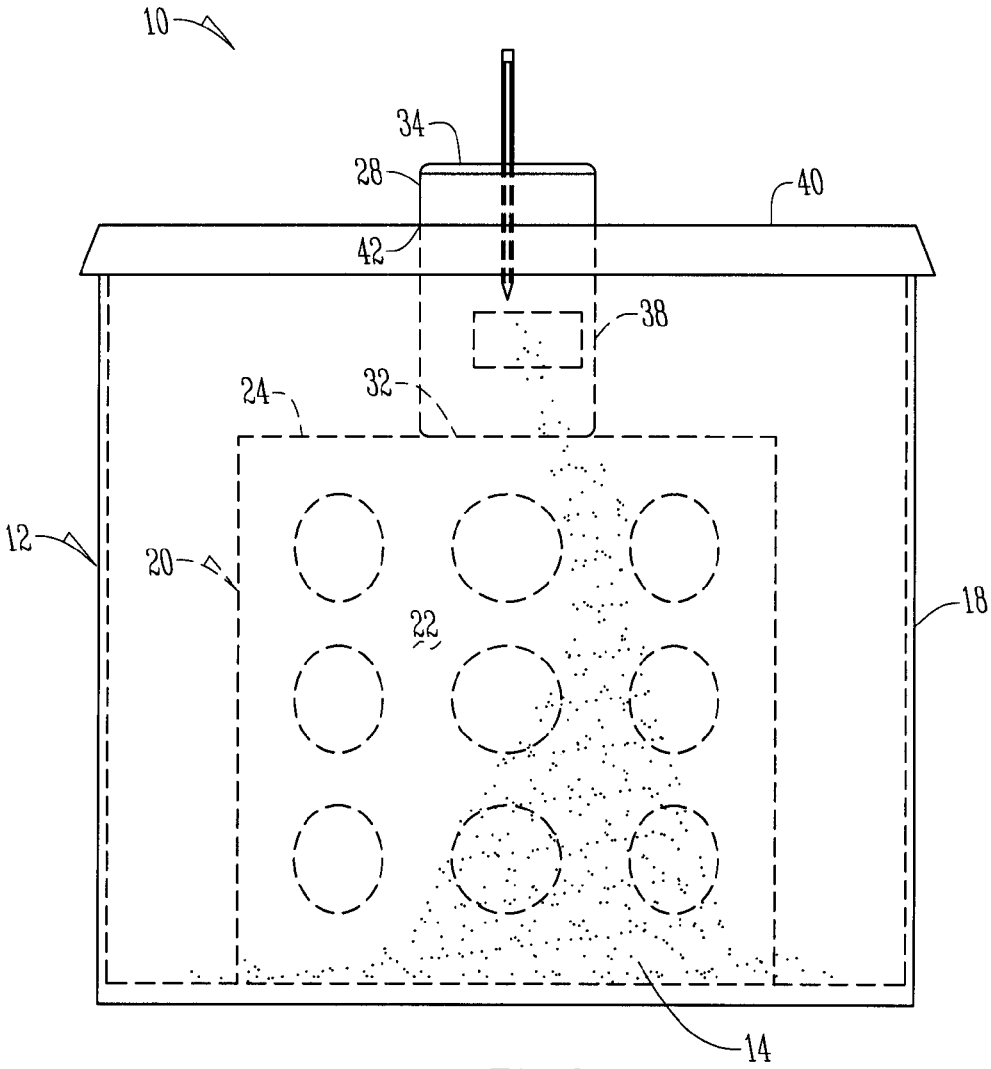
FIG. 2 is a plan side view of the present invention.

Referring to the figures, the pencil sharpening device 10 has a container 12 with a closed bottom end 14, an open top 16, and a cylindrical side wall 18 therebetween. Received within the container 12 is a support member 20 that rests on the bottom 14 of the container and extends upwardly. The support member 20 has a sidewall 22 and a top 24. The top 24 consists of a mounting surface 26 for receiving a sharpening element 28. Additionally the support member 20 has a plurality of apertures 30 disposed through both the sidewall 22 and top 24. The support member can take many forms such as being mounted to the sidewall 18 of the container while still providing a mounting surface 26 and allow shavings to pass through to the hollow area of the container. The sharpening element 28 can be of any conventional type. Preferred is an electric pencil sharpener that has a bottom surface 32 mounted to the support member 20 and extends upwardly from the mounting surface 26. The sharpening element 28 has a top surface 34 with a sharpening bore 36 that is adapted to receive a pencil such that when a pencil is placed within the bore 36, the pencil will be sharpened. The sharpening element 28 additionally has an open side 38 such that shavings in the bore 36 pass through the open side 38.

The container 12 at its opened end 16 has a lid 40 releasably secured thereon. The lid 40 has a centrally located aperture 42 through which the sharpening element 28 extends such that the bore 36 is accessible above the lid 40 and the open side 38 is below the lid 40.

Figure 3:
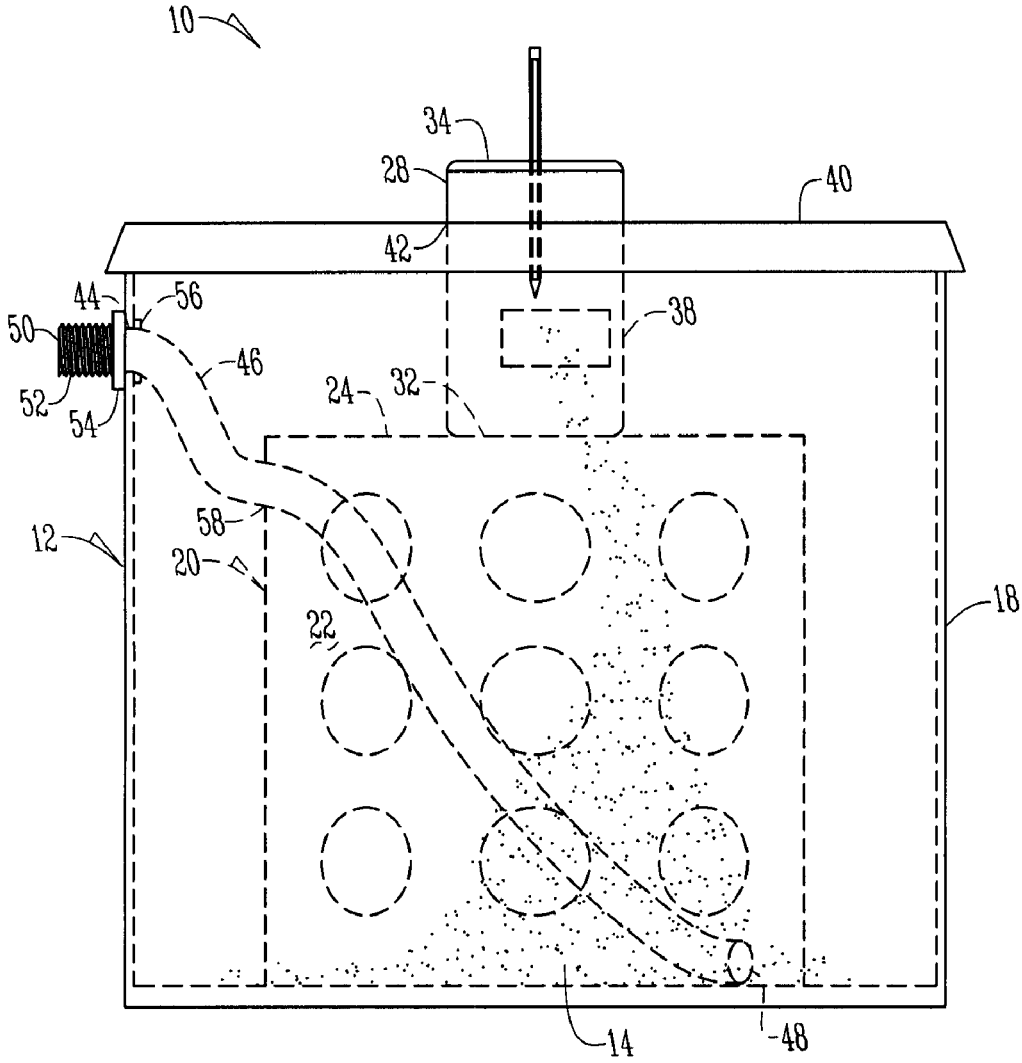
FIG. 3 is a plan side view of an alternative embodiment of a pencil sharpening device having a conduit.

Alternatively, FIG. 3 shows a pencil sharpening device 10 wherein there is an opening 44 disposed through the side wall 18 of container 12. A conduit 46 is disposed through the opening 44 and into the interior of container 12. Conduit 46, preferably is a flexible tube having an inlet end 48 within the hollow container 12 and an outlet end 50 that extends through opening 44. The outlet end 50 has a plurality of threads 52 that are disposed on an external surface of end 50. A nut element 54 is received by the threads 52 and is used in combination with a washer 60 to secure the conduit 46 to the sidewall 18. Within the container 12 the conduit 46 extends through an opening 58 in the support member 20 and rests against the bottom closed end 14.

In operation, once assembled, a pencil is placed in the bore 36 of the sharpening element 28 and pressure is exerted causing the sharpening element to sharpen the pencil. The shavings from the pencil fall from the open side wall 38 of the sharpening element 28. The shavings fall upon the support member 20 as well as through the apertures 30 of the support member 20 and into the hollow area of the container 12. The container can have several options. A container can have a school's logo or colors placed thereon. A sight glass, which is a clear vertical window that shows observers the amount of shavings within the container, can be disposed within the sidewall of the container.

When the container 12 is filled, the lid can be removed and the loose shavings can be disposed of. Alternatively, a vacuum hose of a vacuum cleaner can be inserted over the threads 52 of the flexible conduit 46 so that when the vacuum cleaner is turned on, the shavings within the container 12 are drawn through the flexible conduit 46 into the vacuum cleaner. Alternatively, a plurality of vacuum hoses are connected to a central vacuuming system. Thus each hose is connected to a separate container 12 such that all of the pencil shavings are drawn into the central vacuuming system.

Figure 4:
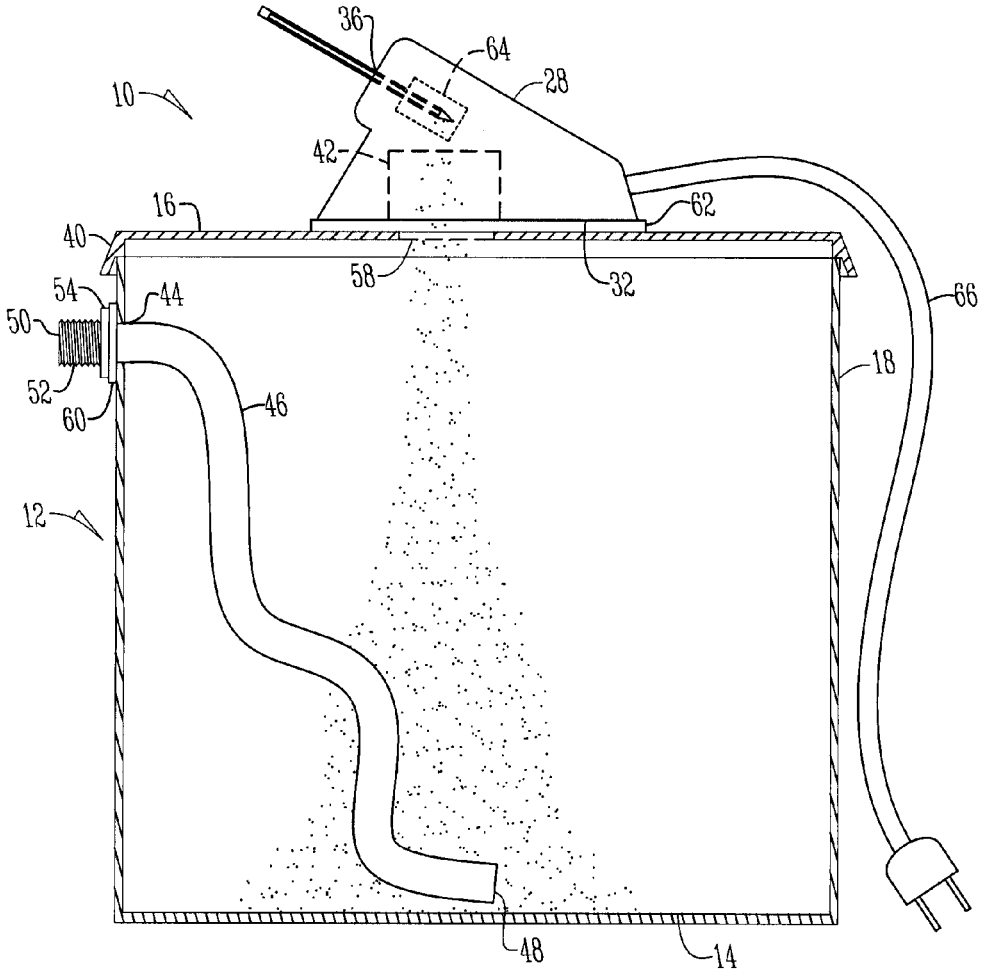
FIG. 4 is a plan side view of an alternate embodiment of a pencil sharpener device with a sharpening element being attached the lid.

In an alternative embodiment, FIG. 4 shows a pencil sharpening device 10 wherein the sharpening element 28 is mounted on a top surface of the lid 40. Disposed between the bottom surface 32 of the sharpening element 28 and the top 16 of the lid 40 is a sealing gasket 62. The purpose of this sealing gasket 62 is to prevent shaving dust from escaping the pencil sharpening device 10 and contaminating the surrounding area. In this embodiment the sharpening element 28 has a sharpening bore 36, sharpening blade 64, cord 66 and aperture 42 for shavings to travel through. Below the aperture 42 of the sharpening element 28 is opening 58 in the lid 40 that is aligned with the aperture 42 of the sharpening element 28.

In operation, once assembled, a pencil is placed in the bore 36 of the sharpening element 28 and pressure is exerted causing the sharpening element to sharpen the pencil. The shavings from the pencil fall through the aperture 42 of the sharpening element 28 and through the opening 58 in the lid 40 and into the hollow area of the container 12.

Figure 5:
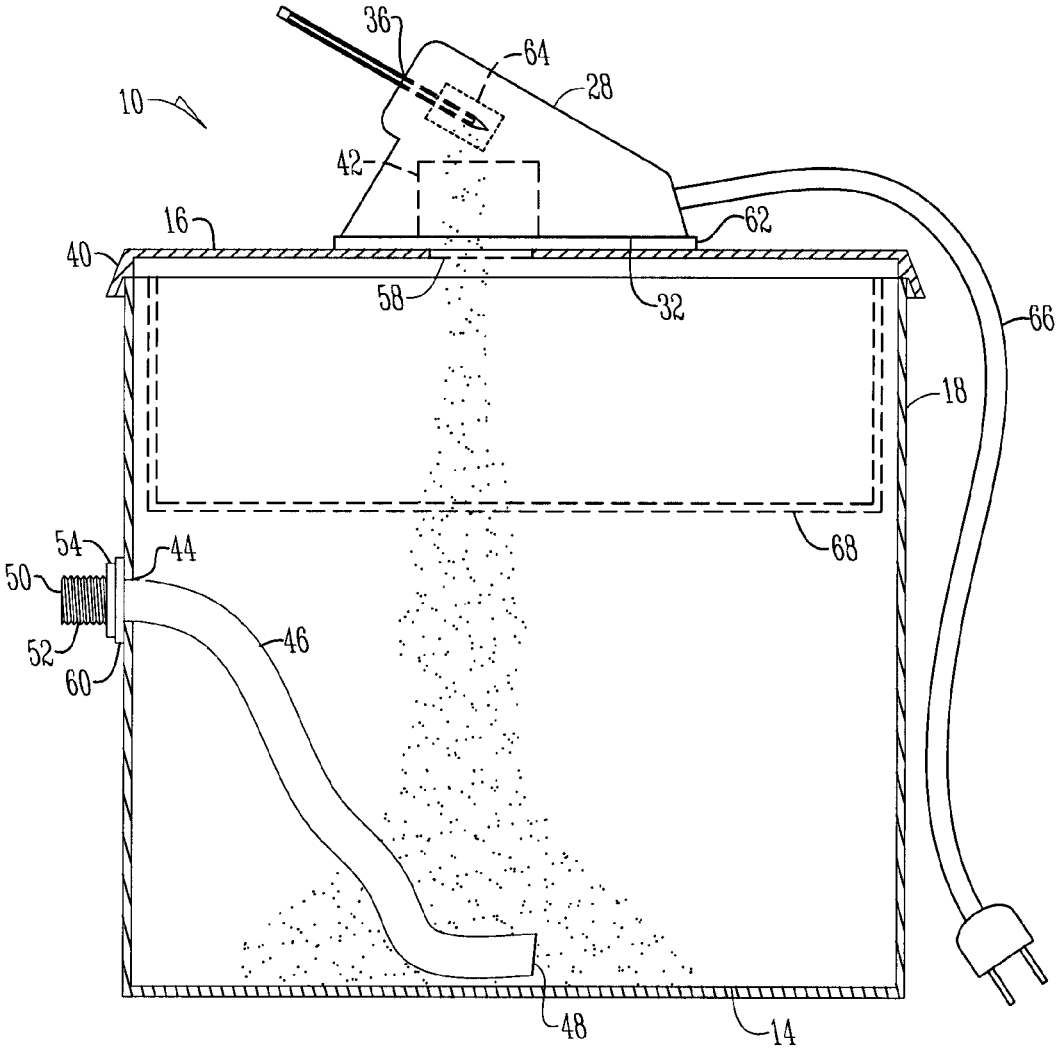
FIG. 5 is a plan side view of an alternate embodiment of a pencil sharpener device with a sharpening element being attached the lid and having a sheath.

In another embodiment, FIG. 5, the lid 40 of the pencil sharpening device 28 is attached to a sheath that fits inside the sidewall 18 of the container 12. This sheath 68 helps prevent the escape of shaving dust and further facilitates the assembly and disassembly of the pencil sharpening device 10 during continued use. Additionally, it may be necessary to reinforce the lid 40 to support the weight of the sharpening element with any conventional means known in the field, including but not limited to a support brace, frame or bars, extra lid thickness or a plate, to name a few.

Figure 6:
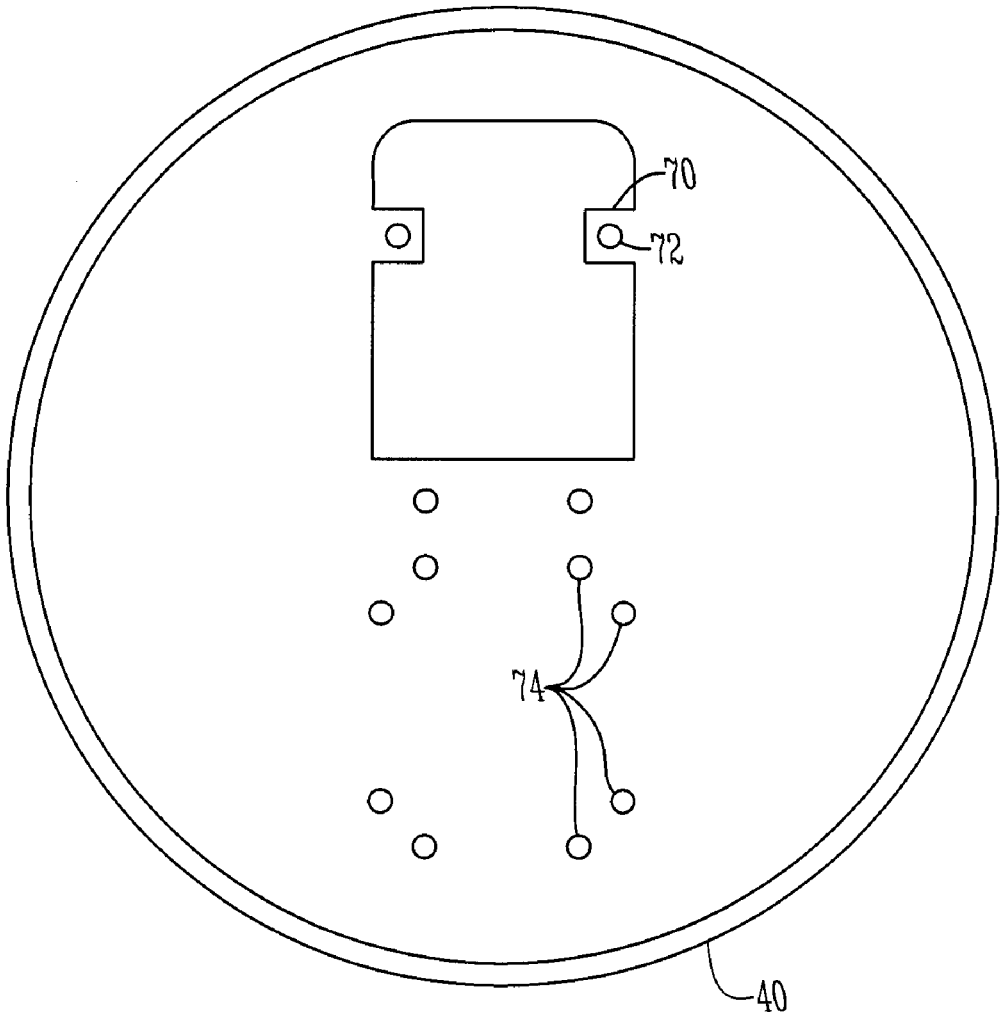
FIG. 6 is a top view of a lid of an alternative embodiment that is meant to receive the sharpening element

FIG. 6 is a top view of the lid 40 and depicts the opening 58. Protruding into the opening 58 are a pair of flanges 70 each with a flange hole 72. In operation the shaft of a bolt or screw or any other attachment means can pass through the flange hole 72 of the flange 70 to attach the sharpening element 28 to the lid 40 of the pencil sharpening device 10. Also present are a plurality of lid holes 74 in the lid 40 which also can used for the attachment of the sharpening element 28 to the lid 40 as well as for access to elements of the bottom 32 of the sharpening element 28.

Because of the size of the container, it generally is a free standing device that does not need to be mounted. Alternatively, the container can be made out of a conventional five gallon bucket that is well known in the art, or any other sized bucket. Further, the container is designed to hold a large quantity of shavings reducing the need for emptying as well as the need for handling and maintenance. Additionally the container is usually designed to stand between 28-30 inches tall to accommodate students of all heights and ages. Thus, the objectives of the present invention have been met by the preceding disclosure.

It will be appreciated by those skilled in the art that other various modifications could be made to the device without the parting from the spirit in scope of this invention. All such modifications and changes fall within the scope of the claims and are intended to be covered thereby.

What is claimed is:

1. A pencil sharpener comprising:

a hollow container having a sidewall, a closed bottom and a lid;

a sharpening element mounted on a top surface of the lid;

an opening in the lid below the sharpening element such that pencil shavings pass through the opening in the lid and into the hollow container wherein the opening in the lid is aligned with an aperture of the sharpening element; and a conduit disposed through an opening in the hollow container having an inlet end within the hollow container.

2. The pencil sharpening device of claim 1 wherein a sealing gasket is disposed between the sharpening element and the lid.

3. The pencil sharpening device of claim 1 wherein the opening in the lid has a pair of flanges.

4. The pencil sharpening device of claim 3 wherein each flange has a flange hole.

5. The pencil sharpening device of claim 1 wherein the lid has a plurality of lid holes.

6. The pencil sharpening device of claim 1 wherein the lid is attached to a sheath.

7. The pencil sharpening device of claim 6 wherein the sheath fits inside the sidewall of the hollow container.

8. The pencil sharpening device of claim 1 wherein the conduit has an outlet end with a plurality of threads for receiving a vacuum hose.

9. The pencil sharpening device of claim 8 wherein a nut element is received by the threads and is used in combination with a washer to secure the conduit to the sidewall.

10. The pencil sharpening device of claim 1 having a sight glass disposed within the sidewall of the container.

11. The pencil sharpening device of claim 1 wherein the lid is reinforced to support the sharpening element.

12. A pencil sharpening device comprising:

a hollow container having a sidewall, a closed bottom and a lid;

a sharpening element mounted on a top surface of the lid;

the sharpening element having an aperture for pencil shavings to pass through;

the lid having an opening below the sharpening element;

the opening in the lid being aligned with the aperture of the sharpening element such that pencil shavings pass through the opening in the lid and into the hollow container; and a conduit disposed through an opening in the hollow container having an inlet end within the hollow container.

* * * * *